US011613716B2

(12) United States Patent
Kikkawa

(10) Patent No.: US 11,613,716 B2
(45) Date of Patent: Mar. 28, 2023

(54) BINDER FOR COAL-CONTAINING FORMED PRODUCT

(71) Applicant: KURITA WATER INDUSTRIES LTD., Tokyo (JP)

(72) Inventor: Takashi Kikkawa, Machida (JP)

(73) Assignee: KURITA WATER INDUSTRIES LTD., Tokyo (JP)

( * ) Notice: Subject to any disclaimer, the term of this patent is extended or adjusted under 35 U.S.C. 154(b) by 0 days.

(21) Appl. No.: 17/046,795

(22) PCT Filed: Mar. 25, 2019

(86) PCT No.: PCT/JP2019/012535
§ 371 (c)(1),
(2) Date: Oct. 11, 2020

(87) PCT Pub. No.: WO2019/198477
PCT Pub. Date: Oct. 17, 2019

(65) Prior Publication Data

US 2021/0155866 A1 May 27, 2021

(30) Foreign Application Priority Data

Apr. 12, 2018 (JP) ..... JP2018-077058

(51) Int. Cl.
*C10L 5/14* (2006.01)
*C10L 5/04* (2006.01)
*C10B 57/04* (2006.01)

(52) U.S. Cl.
CPC ..... *C10L 5/14* (2013.01); *C10B 57/04* (2013.01); *C10L 5/04* (2013.01)

(58) Field of Classification Search
CPC ..... C10L 5/04; C10L 5/14; C10B 57/04
See application file for complete search history.

(56) References Cited

U.S. PATENT DOCUMENTS 4,222,862 A * 9/1980 Finch ..... B03D 1/016 209/166
4,802,914 A 2/1989 Rosen et al.
5,002,607 A * 3/1991 Flesher ..... C22B 1/2406 75/767
5,171,781 A 12/1992 Farrar et al.
6,664,326 B1 * 12/2003 Huang ..... C08F 291/00 524/812
6,964,691 B1 11/2005 Govoni et al.
2018/0179461 A1 6/2018 Michailovski et al.

FOREIGN PATENT DOCUMENTS

| | | | |
|---|---|---|---|
| AU | 497510 | 12/1978 | |
| CN | 101798538 | 8/2010 | |
| CN | 106661474 | 5/2017 | |
| CN | 107660230 | 2/2018 | |
| EP | 0053921 | 6/1982 | |
| JP | S5773084 | 5/1982 | |
| JP | S57140636 | 8/1982 | |
| JP | S609547 | 3/1985 | |
| JP | S6116992 | 1/1986 | |
| JP | 2005240009 | 9/2005 | |
| JP | 4879706 | 2/2012 | |
| WO | 2012137893 | 10/2012 | |
| WO | 2016189044 | 12/2016 | |
| WO | WO-2016189044 A1 * | 12/2016 | ..... C10L 5/14 |

OTHER PUBLICATIONS

"International Search Report (Form PCT/ISA/210) of PCT/JP2019/012535," dated Jun. 18, 2019, with English translation thereof, pp. 1-4.
Zhengang Xu, "Briquette Technology", China Coal Industry Publishing House, with (partial) English translation thereof, Nov. 30, 2001, pp. 1-15.
Zhen Liu, "Textbook for Chemical Analyst—Instrumental Analysis", Chemical Industry Press, with (partial) English translation thereof, Jul. 31, 1983, pp. 1-9.
Wenmin Chen, et al., "Basics of Clean Coal Technology", Beijing: Coal Industry Press, with (partial) English translation thereof, Mar. 31, 1997, pp. 1-7.
"Office Action of Taiwan Counterpart Application" with English translation thereof, dated Mar. 8, 2022, p. 1-p. 11.
"Search Report of Europe Counterpart Application", dated Nov. 11, 2021, p. 1-p. 7.

* cited by examiner

*Primary Examiner* — Cephia D Toomer
(74) *Attorney, Agent, or Firm* — JCIPRNET

(57) ABSTRACT

Provided is a binder for a coal-containing formed product, which contains a macromolecular polymer having an intrinsic viscosity of 2.0 dl/g or higher.

3 Claims, No Drawings

BINDER FOR COAL-CONTAINING FORMED PRODUCT

TECHNICAL FIELD

The present invention relates to a binder for a coal-containing formed product. The binder includes, for example, binders to be used for formed coal used as part of coal charge in coke ovens, and binders to be used when briquettes are fabricated by pressure forming a coal-containing powder.

BACKGROUND ART

For the purpose of retaining the formability of coal-containing formed products and imparting a strength to the formed products, there have conventionally been used binders of bitumen and the like such as tar, tar residue, asphalt, coal tar pitch and pitches (petroleum pitch) made by distilling asphalt or making asphalt heavy.

For example, PTL1 proposes a coke for a blast furnace, containing much bony coal blended therein, which is a coal-containing formed product using a road tar as a binder.

Further PTL2 proposes a coke for a blast furnace, which is a coal-containing formed product using a petroleum pitch and a distilled tar as binders.

CITATION LIST

Patent Literature

PTL1: JP 60-9547 B
PTL2: JP 4879706

SUMMARY OF INVENTION

Technical Problem

When using the above binder, however, there have been a problems in which the processing cost becomes high, etc., since in order to retain the formability of a formed product and impart a strength to the formed product, it is necessary to raise the concentration of the binder to be added with respect to the total amount of the formed product.

Further when coal and the like and the above binder are kneaded, since they cannot be homogeneously kneaded due to a high viscosity of the binder at ordinary temperature, they must be kneaded at a high temperature state using steam. Therefore, there have been a problem in which a dedicated facility capable of heating at a high temperature is required so that the capital spending increases, and the like.

The present invention has been achieved in consideration of the above situation, and an object thereof is to provide a binder for a coal-containing formed product which exhibits a sufficient strength at a low addition concentration and can be used at ordinary temperature.

Solution to Problem

The present invention is based on the finding that a binder for a coal-containing formed product, which contains a macromolecular polymer having an intrinsic viscosity of 2.0 dl/g or higher, exhibits a sufficient strength at a low addition concentration and can be used at ordinary temperature.

That is, the present invention provides the following [1] to [9].

[1] A binder for a coal-containing formed product, comprising a macromolecular polymer having an intrinsic viscosity of 2.0 dl/g or higher.

[2] The binder for a coal-containing formed product according to the above [1], wherein the macromolecular polymer is an anionic polymer or a cationic polymer.

[3] The binder for a coal-containing formed product according to the above [1] or [2], comprising an emulsion comprising the macromolecular polymer.

[4] The binder for a coal-containing formed product according to any one of the above [1] to [3], wherein the macromolecular polymer is at least one selected from the group consisting of polymers of sodium (meth)acrylate, copolymers of sodium (meth)acrylate with acrylamide, and copolymers of (meth)acrylic acid 2-trimethylaminoethyl chloride with acrylamide.

[5] The binder for a coal-containing formed product according to any one of the above [1] to [4], wherein the macromolecular polymer is at least one selected from the group consisting of polymers of sodium acrylate, copolymers of sodium acrylate and acrylamide, and copolymers of acrylic acid 2trimethylaminoethyl chloride with acrylamide.

[6] The binder for a coal-containing formed product according to any one of the above [1] to [5], wherein the intrinsic viscosity is 3.0 dl/g or higher and 30 dl/g or lower.

[7] A method for producing a coal-containing formed product, comprising using the binder according to any one of the above [1] to [6].

[8] The method for producing a coal-containing formed product according to the above [7], wherein the macromolecular polymer is added as an emulsion.

[9] The method for producing a coal-containing formed product according to the above [7] or [8], wherein forming is performed by compression forming.

Advantageous Effects of Invention

The present invention can provide a binder for a coal-containing formed product which exhibits a sufficient strength at a low addition concentration and can be used at ordinary temperature. Further, when the production method according to the present invention is, since a coal-containing formed product can be produced at ordinary temperature, thereby needing no special apparatus, the capital spending can also be reduced.

DESCRIPTION OF EMBODIMENTS

Hereinafter, the binder for a coal-containing formed product according to the present invention will be described in detail.

Here, in the present description, "(meth)acryl" means "acryl" and/or "methacryl."

[Binder for a Coal-Containing Formed Product]

The binder for a coal-containing formed product according to the present invention comprises a macromolecular polymer having an intrinsic viscosity of 2.0 dl/g or higher. The binder for a coal-containing formed product which exhibits a sufficient strength at a low addition concentration and can be used at ordinary temperature can be provided by containing the macromolecular polymer having an intrinsic viscosity of 2.0 dl/g or higher.

The binder for a coal-containing formed product may contain, in addition to the macromolecular polymer having an intrinsic viscosity of 2.0 dl/g or higher, components used in conventional binders, for example, binders of bitumen and the like such as tar, tar residue, asphalt, coal tar pitch and pitches (petroleum pitch) made by distilling asphalt or making asphalt heavy. However, the content of the macromolecular polymer in the binder for a coal-containing formed product is preferably 0.5% by mass or higher, more preferably 1.0% by mass or higher, and still more preferably 1.5% by mass or higher from the viewpoint of providing the binder for a coal-containing formed product which exhibits a sufficient strength at a low addition concentration, and preferably 70.0% by mass or lower, more preferably 60.0% by mass or lower, and still more preferably 50.0% by mass or lower from the viewpoint of ease of handleability.

The content of the macromolecular polymer in active substances of the binder for a coal-containing formed product is preferably 80% by mass or higher, more preferably 90% by mass or higher, still more preferably 98% by mass or higher, and especially preferably 100% by mass from the viewpoint of providing the binder for a coal-containing formed product which exhibits a sufficient strength at a low addition concentration. Here, the active substances mean components excluding a solvent such as water, and components other than the macromolecular polymer (having an intrinsic viscosity of 2.0 dl/g or higher) according to the present invention from the binder.

The binder for a coal-containing formed product may contain resins alone, an aqueous solution containing the macromolecular polymer, an emulsion containing the macromolecular polymer, or the like, and it is preferable that the binder contain an emulsion containing the macromolecular polymer. By containing the emulsion which is relatively low in viscosity and liquid, kneading with components constituting the coal-containing formed product becomes easy and the time taken until the effect is exhibited can also be shortened.

When the binder for a formed product contains the emulsion, the binder may contain, in addition to the emulsion, as required, for example, other components such as a stabilizer and a conventional binder in the range of not impairing the object of the present invention. When the binder for a formed product contains the emulsion, the content of the emulsion in the binder for a formed product is preferably 80% by mass or higher, more preferably 90% by mass or higher, still more preferably 98% by mass or higher, and especially preferably 100% by mass.

Further when the binder for a formed product contains the emulsion, the content of the active substances in the emulsion is preferably 20% by mass or higher, more preferably 30% by mass or higher, and still more preferably 35% by mass or higher, and preferably 60% by mass or lower, more preferably 50% by mass or lower, and still more preferably 45% by mass or lower.

When the binder for a formed product contains the aqueous solution, the binder may contain, in addition to the aqueous solution, as required, for example, other components such as a stabilizer and a conventional binder in the range of not impairing the object of the present invention. When the binder for a formed product contains the aqueous solution, the content of the aqueous solution in the binder for a formed product is preferably 80% by mass or higher, more preferably 90% by mass or higher, still more preferably 98% by mass or higher, and especially preferably 100% by mass.

Further, when the binder for a formed product contains the aqueous solution, the content of the active substances in the aqueous solution is preferably 0.5% by mass or higher, more preferably 1.0% by mass or higher, and still more preferably 1.5% by mass or higher, and preferably 3.5% by mass or lower, more preferably 3.0% by mass or lower, and still more preferably 2.5% by mass or lower.

<Macromolecular Polymer>

The macromolecular polymer contained in the binder for a coal-containing formed product has an intrinsic viscosity of 2.0 dl/g or higher. From the viewpoint of providing the binder for a coal-containing formed product which exhibits a sufficient strength at a low addition concentration, it is preferable that the macromolecular polymer be an anionic polymer or a cationic polymer.

The anionic polymer is not especially limited as long as it has an intrinsic viscosity of 2.0 dl/g or higher.

Examples of the anionic polymer include polymers of (meth)acrylic acid or salts thereof, polymers of partial hydrolyzates of acrylamide, copolymers of (meth)acrylic acid or a salt thereof with acrylamide, polymers of partially sulfomethylated acrylamide, copolymers of a (2-acrylamide)-2-methylpropanesulfonic acid salt with acrylamide, and terpolymers of (meth)acrylic acid or a salt thereof, acrylamide and a (2-acrylamide)-2-methylpropanesulfonic acid salt. These may be used singly or in combinations of two or more. Among these, from the viewpoint of providing the binder for a coal-containing formed product which exhibits a sufficient strength at a low addition concentration and can be used at ordinary temperature, preferable are polymers of sodium (meth)acrylate, and copolymers of sodium (meth) acrylate with acrylamide; more preferable are polymers of sodium acrylate, and copolymers of sodium acrylate with acrylamide; and still more preferable are copolymers of sodium acrylate with acrylamide.

The cationic polymer is not especially limited as long as it has an intrinsic viscosity of 2.0 dl/g or higher.

Examples of the cationic polymer include polymers of a dimethylaminoethyl (meth)acrylate methyl chloride quaternary salt, polymers of diallyldimethylammonium chloride, polymers of alkylamine epichlorohydrin condensates, copolymers of an alkylamine epichlorohydrin condensate with acrylamide, and copolymers of (meth)acrylic acid 2-trimethylaminoethyl chloride with acrylamide. These may be used singly or in combinations of two or more. Among these, from the viewpoint of providing the binder for a coal-containing formed product which exhibits a sufficient strength at a low addition concentration and can be used at ordinary temperature, preferable are copolymers of (meth) acrylic acid 2-trimethylaminoethyl chloride with acrylamide; and more preferable is a copolymer of acrylic acid 2-trimethylaminoethyl chloride with acrylamide.

<Intrinsic Viscosity>

The macromolecular polymer contained in the binder for a coal-containing formed product according to the present invention has an intrinsic viscosity of 2.0 dl/g or higher.

The intrinsic viscosity is represented by [η], and is defined in terms of a value calculated by using the following Huggins formula.

$$\eta_{SP}/C=[\eta]+k'[\eta]^2C \qquad \text{Huggins formula:}$$

where $\eta_{SP}$ represents a specific viscosity ($=\eta_{rel}-1$); k' represents Huggins constant; C represents a concentration of a macromolecular polymer sample solution; and $\eta_{rel}$ represents a relative viscosity.

Macromolecular polymer sample solutions having different concentrations are prepared; the specific viscosity $\eta_{SP}$ of the solution of each concentration is determined; the relation between $\eta_{SP}/C$ and C is plotted; and a value of the intercept obtained by extrapolating the C to 0 is the intrinsic viscosity [η]. Here, used as a blank solution and a solvent for macromolecular polymer sample solutions are: for the anionic polymer, a 1.0 N sodium chloride aqueous solution; for the cationic polymer, a 1.0 N sodium nitrate aqueous solution; for a nonionic polymer, a 1.0 N sodium chloride aqueous solution; and for an amphoteric polymer, a 1.0 N sodium nitrate aqueous solution.

The specific viscosity $\eta_{SP}$ is determined by a method shown in Examples described later.

In the present invention, the intrinsic viscosity of the macromolecular polymer is 2.0 dl/g or higher, preferably 3.0 dl/g or higher, and more preferably 4.0 dl/g or higher from the viewpoint of providing the binder for a coal-containing formed product which exhibits a sufficient strength at a low addition concentration, and preferably 30 dl/g or lower, more preferably 26 dl/g or lower, and still more preferably 22 dl/g or lower from the viewpoint of ease of kneading with coal.

[Coal-Containing Formed Product]

The coal-containing formed product according to the present invention contains at least coal. Components other than coal to be contained are not especially limited, but examples thereof include iron ore, metal oxides, vegetable waste (biomass) and slaked lime.

The content of the coal in the coal-containing formed product is preferably 50% by mass or higher, and more preferably 80% by mass or higher.

Further, it is preferable that the coal-containing formed product be obtained by forming a powder containing coal.

The coal contained in the formed product is not especially limited, but examples thereof include anthracite, semi-anthracite, bituminous coal, sub-bituminous coal and brown coal.

The content of the macromolecular polymer in the coal-containing formed product is, with respect to the total amount of components (excluding moisture contained in coal) constituting the coal-containing formed product, preferably 0.01% by mass or higher, more preferably 0.05% by mass or higher, and still more preferably 0.10% by mass or higher from the viewpoint of providing the coal-containing formed product exhibiting a sufficient strength, and preferably 10.00% by mass or lower, more preferably 5.00% by mass or lower, and still more preferably 1.00% by mass or lower from the viewpoint of reducing the processing cost.

When a conventional binder as a binder is used concurrently with the macromolecular polymer, the content of the conventional binder in the coal-containing formed product is, with respect to the total amount of components (excluding moisture contained in coal) constituting the coal-containing formed product, preferably 5% by mass or lower, more preferably 3% by mass or lower, and still more preferably 1% by mass or lower.

[Method for Producing the Coal-Containing Formed Product]

A method for producing the coal-containing formed product is not especially limited, but it is preferable that the coal-containing formed product be produced by forming by compression forming. By forming by compression forming, the formed product excellent in the strength can be easily provided.

The pressure in the compression forming is, from the viewpoint of providing the coal-containing formed product excellent in the strength, preferably 0.5 t/cm$^2$ or higher, and more preferably 1.0 t/cm$^2$ or higher, and preferably 10 t/cm$^2$ or lower, and more preferably 5 t/cm$^2$ or lower.

The macromolecular polymer to be used in the binder for a coal-containing formed product is preferably an anionic polymer or a cationic polymer from the viewpoint of providing the binder for a coal-containing formed product which exhibits a sufficient strength at a low addition concentration.

Then, when the coal-containing formed product is produced, the macromolecular polymer may be added to components constituting the coal-containing formed product, in a resin state, or as an aqueous solution, or as an emulsion. Among these, from the viewpoint of ease of kneading with components constituting the coal-containing formed product and shortening the time taken until the effect is exhibited, it is preferable that the macromolecular polymer be added as an emulsion which is relatively low in the viscosity and liquid.

Further the macromolecular polymer, in consideration of ease of kneading with components constituting the coal-containing formed product, may be added by being sprayed in fine droplets by using a two-fluid nozzle or the like.

EXAMPLES

Then, the present invention will be described in more detail by way of Examples, but the present invention is not limited to these Examples in any way.

Production of Formed Products

Examples 1, 4, 5 and 7

An emulsion having a macromolecular polymer concentration (active substance concentration) indicated in Table 1 was added to 100 g of a coal whose moisture content at ordinary temperature was 8% by mass so that the concentration of the active substance in the binder became 0.2% by mass with respect to the total amount of components other than moisture in the coal and the active substance in the binder; and water was sprayed by a sprayer so that the total of the amount of the emulsion added and the water became 2 g; and thereafter, the resultant was mixed for 2 min by a spatula.

After the mixing, a pressure of about 1.0 t/cm$^2$ was applied on the obtained mixture by a uniaxial compression forming machine to thereby fabricate a cylindrical formed coal of about 4 cm in height and about 2 cm in diameter.

Examples 2, 3 and 6

100 g of a coal whose moisture content at ordinary temperature was 8% by mass was heated at a temperature of 105° C. for 120 min to evaporate the moisture in the coal to dry the coal.

Then, a macromolecular polymer indicated in Table 1 was added to water so that the macromolecular polymer concentration (active substance concentration) became the concentration indicated in Table 1, and stirred for 20 min by using a magnetic stirrer. An aqueous solution in which the macromolecular polymer was dissolved in water (macromolecular polymer sample solution) was thus obtained as the binder.

Then, 10 ml of the obtained aqueous solution was added to the coal (whose weight before drying was 100 g) dried as described above so that the concentration of the active substance of the binder became 0.2% by mass with respect to the total amount of components other than moisture in the coal and the active substance of the binder, and mixed for 2 min by a spatula.

After the mixing, a pressure of about 1.0 t/cm$^2$ was applied on the obtained mixture by a uniaxial compression forming machine to thereby fabricate a cylindrical formed coal of about 4 cm in height and about 2 cm in diameter.

Comparative Example 1

A tar heated to 80° C. was added, under a sealed condition, to 100 g of a coal which was heated to 80° C. and whose moisture content was 8% by mass so that the tar concentration became 5.0% by mass with respect to the total amount of components other than moisture in the coal and the tar (binder), and mixed for 2 min by a spatula.

A pressure of about 1.0 t/cm$^2$ was applied on the obtained mixture by a uniaxial compression forming machine to thereby fabricate a cylindrical formed coal of about 4 cm in height and about 2 cm in diameter.

Comparative Examples 2 to 5

100 g of a coal whose moisture content at ordinary temperature was 8% by mass was heated at a temperature of 105° C. for 120 min to evaporate the moisture in the coal to dry the coal.

Then, a macromolecular polymer indicated in Table 1 was added to water so that the macromolecular polymer concentration (active substance concentration) became the concentration indicated in Table 1, and stirred for 20 min by using a magnetic stirrer. An aqueous solution in which the macromolecular polymer was dissolved in water (macromolecular polymer sample solution) was thus obtained as the binder.

Then, the obtained aqueous solution was added to the coal (whose weight before drying was 100 g) dried as described above so that the concentration of the active substance of the binder became 0.2% by mass with respect to the total amount of components other than moisture in the coal and the active substance of the binder, and mixed for 2 min by a spatula.

After the mixing, a pressure of about 1.0 t/cm$^2$ was applied on the obtained mixture by a uniaxial compression forming machine to thereby fabricate a cylindrical formed coal of about 4 cm in height and about 2 cm in diameter.

[Measurement]

<Intrinsic Viscosity>

The intrinsic viscosity of a macromolecular polymer used as the binder was determined as follows.

(1) 5 Cannon-Fenske viscometers (manufactured by Kusano Kagaku K.K., No. 75) were dipped in a neutral detergent for glassware for 1 day or longer, and thereafter sufficiently washed with deionized water and dried.

(2-1) For binders Nos. A1 to A4, Z2 and Z3 each, a solution of a macromolecular polymer was fabricated by using water so that the macromolecular polymer concentration became 0.2% by mass, and subjected to dead end filtratopm through a glass filter 3G2; thereafter, 50 mL of a 2 N sodium chloride aqueous solution was added to 50 mL of the obtained 0.2% by mass solution, and stirred by a magnetic stirrer at 500 rpm for 20 min to thereby obtain a 1 N sodium chloride aqueous solution of a macromolecular polymer concentration of 0.1% by mass. The resultant was diluted with a 1 N sodium chloride aqueous solution to thereby prepare macromolecular polymer sample solutions having 5 serial concentrations in the range of 0.02 to 0.1% by mass. Here, the 1 N sodium chloride aqueous solution (1 N-NaCl) was used as a blank solution.

(2-2) For binders Nos. A5 to A7, Z4 and Z5 each, macromolecular polymer sample solutions were prepared by using a 2 N or 1 N sodium nitrate aqueous solution in place of the 2 N or 1 N sodium chloride aqueous solution in the above (2-1). Here, the 1 N sodium nitrate aqueous solution (1 N-$NaNO_3$) was used as a blank solution.

(3) The above 5 viscometers were installed vertically in a thermostatic water bath whose temperature was regulated at 30° C. (±0.02° C. or lower). 10 mL of the blank solution was put in each viscometer by a whole pipette, and thereafter allowed to stand still for 30 min to make the temperature to become constant. Thereafter, the solution was suctioned by using a dropper plug and caused to spontaneously dropping, and the time when the solution passed the marked line was measured to the 1/100 sec unit by a stopwatch. This measurement was repeated 5 times for each viscometer and the average value was taken as a blank value ($t_0$).

(4) 10 mL of each of the above prepared macromolecular polymer sample solutions having 5 serial concentrations was put in each one of the 5 viscometers by which the measurement of the blank solution had been carried out, and allowed to stand still for about 30 min to make the temperature constant. Thereafter, the same operation as in the measurement of the blank solution was repeated 3 times, and the average value of the passing times for each concentration was taken as a measurement value (t).

(5) The relative viscosity $\eta_{rel}$ and the specific viscosity $\eta_{SP}$ were determined from the blank value $t_0$ and the measurement value t by the following relational formula.

$$\eta_{rel}=t/t_0$$

$$\eta_{SP}=(t-t_0)/t_0=\eta_{rel}-1$$

The intrinsic viscosity [η] of each macromolecular polymer was calculated from these values according to the determination method of the intrinsic viscosity based on the following Huggins formula.

$$\eta_{SP}/C=[\eta]+k'[\eta]^2C \quad \text{Huggins formula:}$$

where k' represents Huggins constant; and C represents the concentration of the macromolecular polymer sample solution [% by mass/volume] (=C [g/dL]).

[Evaluation]

<Fluidity>

The fluidity at ordinary temperature of the emulsions containing a macromolecular polymer, the macromolecular polymer aqueous solutions and the tar right before being added to coal was visually evaluated. The results are shown in Table 1.

As seen in Examples 1, 4, 5 and 7, when the form of the binders when being added to the coal was an emulsion, the binders had fluidity; and as seen in Examples 2, 3 and 6, when the form of the binders when being added to the coal was an aqueous solution, the binders all had no fluidity and were gelatinous. When a binder had fluidity, since it became easy for the binder to be kneaded with components constituting a coal-containing formed product, in Examples 1, 4, 5 and 7, kneading with coal was easy. By contrast, in Examples 2, 3 and 6, the binder had no fluidity and was gelatinous and kneading with coal was not easy, but homogeneous kneading was possible.

Comparative Example 1 had no fluidity and homogeneous kneading with coal at ordinary temperature was difficult. In Comparative Examples 2 to 5, since their intrinsic viscosity was low, the binders had fluidity, and kneading with coal was easy.

<Strength (Residual Ratio)>

3 pieces of a formed coal were fabricated under the condition of each of Examples and Comparative Examples, and weighed, and thereafter, the average weight of the 3 pieces thereof was determined and taken as an average weight before a drop test.

The 3 pieces thereof weighed were each dropped from a height of 2 m, and the weight of the largest lump in broken formed coal in each piece thereof was measured. The drop test was carried out on the 3 pieces thereof fabricated under the condition of each of Examples and Comparative Examples. The average weight of the largest lumps in broken formed coal in the 3 pieces thereof fabricated under each condition was determined, and taken as an average weight after the drop test. Then, the residual ratio was calculated by using the following expression, and taken as an index of the strength of the formed coal.

An average weight (g) after the drop test/an average weight (g) before the drop test×100=the residual ratio (% by mass)

The results are shown in Table 1. A binder having a higher residual ratio has a better strength.

used at ordinary temperature, whereas the binder of Comparative Example 1 needs to be heated for use.

Then, by comparison of Examples 1 to 7 with Comparative Examples 2 to 5, it is clear that the intrinsic viscosity being 2.0 dL/g or higher led to the exhibition of a sufficient strength.

Further by comparison of Example 3 with Example 4, it is clear that a macromolecular polymer being an emulsion gave more fluidity and gave a lower binder viscosity than the macromolecular polymer being an aqueous solution. Therefore, it is considered that a macromolecular polymer being an emulsion made easy the kneading of the macromolecular polymer with components constituting a coal-containing formed product.

TABLE 1

| | Binder | | | | | | Active substance concentration | Evaluation | |
|---|---|---|---|---|---|---|---|---|---|
| | No | Binder kind (% by mol) | Addition form*1 | Ionicity | Active substance concentration (% by mass) | Intrinsic viscosity (dL/g) | (% by mass) of binder in formed product*2 | Fluidity*3 | Residual ratio (% by mass) |
| Example 1 | A1 | NaA polymer (100) | emulsion | anionic | 40.0 | 6.0 | 0.2 | present | 98 |
| Example 2 | A2 | NaA/AAm copolymer (4/96) | aqueous solution | anionic | 2.0 | 14.0 | 0.2 | absent | 98 |
| Example 3 | A3 | NaA/AAm copolymer (20/80) | aqueous solution | anionic | 2.0 | 18.8 | 0.2 | absent | 99 |
| Example 4 | A4 | NaA/AAm copolymer (20/80) | emulsion | anionic | 40.0 | 20.0 | 0.2 | present | 99 |
| Example 5 | A5 | DAA/AAm copolymer (50/50) | emulsion | cationic | 40.0 | 4.1 | 0.2 | present | 99 |
| Example 6 | A6 | DAA/AAm copolymer (85/15) | aqueous solution | cationic | 2.0 | 9.6 | 0.2 | absent | 99 |
| Example 7 | A7 | DAA/AAm copolymer (80/20) | emulsion | cationic | 40.0 | 10.5 | 0.2 | present | 98 |
| Comparative Example 1 | Z1 | tar | liquid | — | 100.0 | — | 5.0 | absent | 71 |
| Comparative Example 2 | Z2 | NaA polymer (100) | aqueous solution | anionic | 30.0 | 0.4 | 0.2 | present | 60 |
| Comparative Example 3 | Z3 | NaA/AAm copolymer (40/60) | aqueous solution | anionic | 20.0 | 1.5 | 0.2 | present | 39 |
| Comparative Example 4 | Z4 | AAECH polymer (100) | aqueous solution | cationic | 50.0 | 0.1 | 0.2 | present | 41 |
| Comparative Example 5 | Z5 | DADMAC polymer (100) | aqueous solution | cationic | 17.0 | 0.8 | 0.2 | present | 57 |

*1Form of binder when being added to coal
*2Concentration of active substance of binder with respect to the total amount of components other than moisture in coal and the active substance of the binder
*3Fluidity of binder right before being added to coal, at ordinary temperature Abbreviations in Table 1 are as follows.

NaA: sodium acrylate

AAm: acrylamide

DAA: acrylic acid 2-trimethylaminoethyl chloride

AAECH: an alkylamine epichlorohydrin condensate

DADMAC: diallyldimethylammonium chloride

From the results in Table 1, it is clear that the binders of Examples 1 to 7 exhibited a more sufficient strength at a low addition concentration than the binder of Comparative Example 1. Further the binders of Examples 1 to 7 can be

The invention claimed is:

1. A coal-containing compression-formed product, comprising a binder and 50% or more by mass of coal, wherein the binder comprises an emulsion comprising a macromolecular polymer having an intrinsic viscosity of 3.0 dl/g or higher and 30 dl/g or lower, wherein a content of the macromolecular polymer in the emulsion is 20% by mass or higher and 60% by mass or lower, and the macromolecular polymer is at least one selected from the group consisting of polymers of sodium (meth)

acrylate, copolymers of sodium (meth)acrylate with acrylamide, and copolymers of (meth)acrylic acid 2-trimethylaminoethyl chloride with acrylamide.

2. The coal-containing compression-formed product according to claim 1, wherein the macromolecular polymer is at least one selected from the group consisting of polymers of sodium acrylate, copolymers of sodium acrylate and acrylamide, and copolymers of acrylic acid 2-trimethylaminoethyl chloride with acrylamide.

3. A method for producing a coal-containing compression-formed product, comprising:

combining a binder with at least coal to obtain a mixture, wherein the binder comprises an emulsion comprising a macromolecular polymer having an intrinsic viscosity of 3.0 dl/g or higher and 30 dl/g or lower, and a content of the macromolecular polymer in the emulsion is 20% by mass or higher and 60% by mass or lower; and compressing the mixture, wherein the produced coal-containing compression-formed product comprises 50% or more by mass of the coal, and the macromolecular polymer is at least one selected from the group consisting ofpolymers of sodium (meth) acrylate, copolymers of sodium (meth)acrylate with acrylamide, and copolymers of (meth)acrylic acid 2-trimethylaminoethyl chloride with acrylamide.

* * * * *